US010368654B2

(12) United States Patent
Sopher

(10) Patent No.: US 10,368,654 B2
(45) Date of Patent: Aug. 6, 2019

(54) BED SHEET SYSTEM

(71) Applicant: The QuickZip Sheet Company, Denver, CO (US)

(72) Inventor: Elizabeth Jane Sopher, Denver, CO (US)

(73) Assignee: THE QUICKZIP SHEET COMPANY, LLC, Denver, CO (US)

( * ) Notice: Subject to any disclaimer, the term of this patent is extended or adjusted under 35 U.S.C. 154(b) by 324 days.

(21) Appl. No.: 15/335,844

(22) Filed: Oct. 27, 2016

(65) Prior Publication Data

US 2017/0112292 A1 Apr. 27, 2017

Related U.S. Application Data

(60) Provisional application No. 62/247,188, filed on Oct. 27, 2015.

(51) Int. Cl.
*A47C 21/02* (2006.01)

(52) U.S. Cl.
CPC ..... *A47C 21/022* (2013.01)

(58) Field of Classification Search
CPC ..... A47C 21/022
See application file for complete search history.

(56) References Cited

U.S. PATENT DOCUMENTS 2,154,910 A 4/1939 Magaril
2,400,731 A 5/1946 Armstrong
2,789,292 A 4/1957 Budinquest
2,907,055 A 10/1959 Berman
2,973,526 A * 3/1961 Wetzler ..... A47C 21/022 5/737
3,027,573 A 4/1962 Bell, Jr.
3,287,749 A 11/1966 Marisco
(Continued)

FOREIGN PATENT DOCUMENTS

FR 2579439 10/1986

OTHER PUBLICATIONS

International Search Report and Written Opinion for International (PCT) Patent Application No. PCT/US2016/059044, dated Jan. 5, 2017 9 pages.

(Continued)

*Primary Examiner* — Eric J Kurilla
(74) *Attorney, Agent, or Firm* — Lewis Brisbois Bisgaard & Smith LLP

(57) ABSTRACT

A system and method of changing a sheet for a mattress of a bed is provided. More specifically, a bedding system includes a retention element sized to be retained on the mattress. A first bedding element is selectively interconnected to the retention system. Optionally, a second bedding element may be interconnected to the first bedding element. In one embodiment, at least one two-part closure interconnects the first bedding element to the retention element. In another embodiment, buttons interconnect the second bedding element to the first bedding element. In yet another embodiment, at least one two-part closure interconnects the second bedding element to the first bedding element. The two-part closure may be a zipper, a plurality of snaps, and a hook and loop system. In one embodiment, the retention element is removably interconnected to the mattress by at least one fastener or closure.

9 Claims, 10 Drawing Sheets

(56) References Cited

U.S. PATENT DOCUMENTS 3,493,980 A 2/1970 Haller
3,530,487 A * 9/1970 Beer ..... A47G 9/02 5/494
3,570,026 A 3/1971 Allison
3,581,322 A 6/1971 Marsico
3,591,875 A 7/1971 Zipf, III et al.
3,789,441 A 2/1974 Weiss
3,857,124 A * 12/1974 Hadley ..... A47C 21/022 5/485
3,950,800 A 4/1976 Garshfield
4,266,307 A 5/1981 Critelli
4,301,561 A * 11/1981 McLeod ..... A47C 21/022 5/496
4,388,738 A 6/1983 Wagner
4,389,744 A * 6/1983 Monroe ..... A47G 9/02 5/496
4,488,323 A * 12/1984 Colburn ..... A47C 21/022 5/496
4,490,866 A 1/1985 Stanton
4,903,361 A 2/1990 Tang
4,922,565 A 5/1990 Blake
4,951,335 A 8/1990 Eady
5,003,655 A 4/1991 Kafai
5,027,456 A 7/1991 Wadsworth
5,042,099 A 8/1991 Brenner et al.
5,065,485 A 11/1991 Zocco
5,086,530 A 2/1992 Blake
5,099,531 A * 3/1992 Schmier ..... A47C 21/022 5/494
5,101,527 A 4/1992 Wadsworth, III et al.
5,134,736 A 8/1992 Anthony et al.
5,136,741 A 8/1992 Balonick et al.
5,208,926 A * 5/1993 Stackhouse ..... A47C 21/022 5/482
5,321,862 A * 6/1994 Campbell ..... A47C 21/022 5/482
5,398,354 A 3/1995 Balonick et al.
5,414,882 A 5/1995 Goodale
5,628,093 A * 5/1997 Goodale ..... A44B 19/382 24/381
5,644,811 A 7/1997 Cavazos
5,794,285 A * 8/1998 Burch ..... A47G 9/02 5/494
5,966,759 A * 10/1999 Sanders ..... A47C 27/007 5/497
6,044,503 A * 4/2000 McClendon ..... A47G 9/02 5/482
6,098,219 A * 8/2000 Milber ..... A47G 9/02 5/494
6,108,836 A 8/2000 Keene, III
6,243,895 B1 6/2001 Amin
6,263,532 B1 7/2001 Miller
6,757,923 B2 7/2004 Sopher et al.
6,859,962 B2 3/2005 Diak/Ghanem
6,886,197 B1 * 5/2005 Madigan ..... A47G 9/02 5/482
7,007,325 B1 * 3/2006 Gomeh ..... A47C 21/022 5/496
7,047,580 B2 5/2006 Finn
7,231,679 B2 6/2007 Ho
7,487,561 B2 2/2009 Ho
7,669,257 B2 * 3/2010 Swihart ..... A47G 9/02 5/496
7,827,633 B2 * 11/2010 Taylor ..... A47C 21/022 5/488
7,975,334 B1 7/2011 Vensel
8,032,959 B2 10/2011 Rowson et al.
8,082,612 B2 * 12/2011 Saunders ..... A47C 31/105 5/484
8,122,541 B1 * 2/2012 Georgatos ..... A47G 9/0238 5/494
8,321,980 B2 12/2012 Maloney
8,332,976 B1 12/2012 Goldwater
8,393,025 B2 3/2013 Crispino et al.
8,627,521 B2 1/2014 Rowson et al.
8,726,907 B2 5/2014 Strauch et al.
8,898,834 B1 12/2014 Huber et al.
8,898,835 B2 12/2014 Khan
9,021,631 B2 5/2015 Miner
9,549,625 B1 * 1/2017 Wilkinson ..... A47G 9/02
2002/0148047 A1 10/2002 Corzani et al.
2003/0000014 A1 * 1/2003 Sopher ..... A47G 9/0246 5/496
2003/0106157 A1 6/2003 Rugset
2003/0177579 A1 9/2003 Diak
2004/0139552 A1 7/2004 Walters
2005/0177942 A1 8/2005 Finn
2005/0217030 A1 10/2005 Seigler
2007/0113341 A1 5/2007 Ho
2007/0174962 A1 8/2007 Smith
2008/0289104 A1 11/2008 Rowson et al.
2009/0265855 A1 10/2009 Hawk
2010/0154122 A1 6/2010 Crispino et al.
2010/0223726 A1 9/2010 Maloney
2014/0143954 A1 5/2014 Miner
2015/0182032 A1 7/2015 Jensen et al.

OTHER PUBLICATIONS

"ZippySack," Jay at Play, believed to be sold as early as Oct. 22, 2013, retrieved from www.zippysack.com, retrieved on May 5, 2017, 6 pages.

* cited by examiner

BED SHEET SYSTEM

CROSS-REFERENCE TO RELATED APPLICATIONS

This application claims priority under 35 U.S.C. § 119(e) to U.S. Provisional Patent Application Ser. No. 62/247,188, filed Oct. 27, 2015, which is incorporated by reference in its entirety.

FIELD OF THE INVENTION

Embodiments of the present invention relate generally to a bedding system. More specifically, the bedding system includes a retention element retained on a bed mattress. A first bedding element is removably interconnectable to the retention element. The bedding system may optionally include a second bedding element removably interconnectable to the first bedding element. In this manner, the first and second bedding elements may be removably interconnected to the mattress by the retention element.

BACKGROUND

When a bed is slept in, sheets become loose and blankets may slide off of the bed and end up on the floor. Because of this, the occupant's sleep may be interrupted to rearrange the sheets or retrieve the blanket from the floor. This is particularly a problem during non-domestic sleep experiences for beds located in recreational vehicles, campers, and tents.

Additionally, making up the bed after it has been slept in is often difficult and time consuming because sheets and blankets frequently become disarrayed due to occupant movement. To change or straighten the sheets they must often be pulled over (in the case of a fitted sheet) and/or tucked underneath the mattress (in the case of a flat sheet). The mattress weight and design and bed frame design can all contribute to difficulty in making up the bed or changing the sheets. External factors, such as bed rails, furniture around the bed, and walls close to the bed, may further increase the difficulty of making up the bed or changing the sheet by limiting access to the bed.

Thus, there is a need for a bedding system that improves both sheet function as well as bed covers to create ease of changing sheets, ease of making the bed, and a more comfortable sleep experience.

SUMMARY OF THE INVENTION

Some embodiments of the present invention provide a bedding system for a mattress that is easy to change and stays securely on the mattress. The bedding system generally comprises a retention element and a first bedding element selectively interconnected to the retention element. Optionally, a second bedding element may be interconnected to the first bedding element. The bedding system also improves safety for babies and young children by mitigating entrapment hazards, and limits corners from popping off during placement on the mattress or during sleep.

One aspect of the bedding system is that it is easy to fold. The bedding system may be washed and dried as one piece with its components interconnected. Alternatively, one or more portions of the bedding system may be washed and dried separately.

It is another aspect of embodiments of the present invention to provide a retention element sized to be retained on a mattress. The retention element includes at least one part of a closure to receive a first bedding element. In one embodiment, the retention element does not contact a bottom surface portion of the mattress. In another embodiment, the retention element contacts a portion of the mattress bottom. Optionally, the retention element may substantially all, or all, of the mattress bottom. The retention element may be interconnected to the mattress by, for example, one or more fasteners. In one embodiment, the retention element includes button holes that align with buttons positioned on mattress. Alternatively, the retention element may be interconnected to the mattress by one or more two-part closures, such as snaps, a hook and loop systems, and zippers.

It is another aspect of some embodiments of the present invention to provide a first bedding element that is selectively interconnectable to a mattress of a bed. In one embodiment, the first bedding element is interconnectable to the retention element and, optionally, to a second bedding element. In another embodiment, the first bedding element is interconnectable directly to the bed mattress without use of the retention element. The first bedding element generally includes at least one part of a closure for interconnection to the retention element or the mattress. In one embodiment, the closure is a two-part closure. Optionally, the first bedding element includes at least one part of a two-part closure for interconnection to the second bedding element. In one embodiment, the first bedding element includes at least one of a button and a button hole for interconnection to one or more of the second bedding element, the retention element, and the mattress. In another embodiment, at least one of the two-part closures is a zipper. In one embodiment, the first bedding element is a sheet. In another embodiment, the second bedding element is one of a sheet, a blanket, and a duvet.

It is still yet another aspect of embodiments of the present invention to provide a second bedding element that is selectively interconnectable to the first bedding element. The second bedding element generally includes at least one part of a two-part closure for interconnection to the first bedding element. In one embodiment, the second bedding element is one of a sheet, a blanket, and a duvet. The duvet may include a pocket accessible by an aperture to selectively receive insulating material to regulate the retention of heat. Optionally, the two-part closure may comprise a zipper or a plurality of buttons that are received in button holes.

It is another aspect of the present invention to provide a bedding system selectively retained by a mattress of a bed. The bedding system comprises: (1) a retention element selectively received by the mattress, the retention element including a first portion of a first closure; (2) a first bedding element selectively interconnectable to the retention element, the first bedding element including: (i) a longitudinal axis; (ii) a second portion of the first closure; (iii) a first portion of a second closure generally parallel to the longitudinal axis; and (iv) a first portion of a third closure generally parallel to the longitudinal axis; and (3) a second bedding element selectively interconnectable to the first bedding element, the second bedding element including: (i) a second portion of the second closure; and (ii) a second portion of the third closure. In one embodiment, the retention element may be interconnected to the mattress by one or more of a hook and loop system, a zipper, buttons, and snaps.

In one embodiment, the first portion of the second closure is closer to a first peripheral edge of the first bedding element than the second portion of the first closure. Additionally, the first portion of the third closure is closer to a second peripheral edge of the first bedding element than the second portion of the first closure.

In some embodiments, the first bedding element further comprises: (i) a medial panel; (ii) a first panel extending from a first longitudinal edge of the medial panel; and (iii) a second panel extending from a second longitudinal edge of the medial panel. The second portion of the first closure is interconnected to the medial panel, the first portion of the second closure is interconnected to the first panel, and the first portion of the third closure is interconnected to the second panel.

In one embodiment, the second bedding element has a width that is greater than a width of the first bedding element. The second portion of the second closure may be interconnected to the second bedding element proximate to a first peripheral edge of the second bedding element and the second portion of the third closure may be interconnected to the second bedding element proximate to a second peripheral edge of the second bedding element. Optionally, each of the second portion of the first closure, the first portion of the second closure, and the first portion of the third closure are interconnected to an interior surface portion of the first bedding element.

The mattress includes four sidewalls. In one embodiment, the retention element includes a first longitudinal panel connected to a second longitudinal panel by first and second transverse panels such that, when the retention element is retained by the mattress, each of the longitudinal panels and the transverse panels contacts at least a portion of one of the four sidewalls of the mattress. Optionally, the retention element includes a bottom panel that contacts at least a portion of a bottom portion of the mattress when the retention element is retained by the mattress. In some embodiments, first bedding element is a sheet and the second bedding element is a duvet including a pocket to receive an insulation.

It is still another aspect of the present invention to provide a bedding system that is selectively interconnectable to a mattress of a bed. The bedding system includes, but is not limited to: (1) a retention element adapted to cover at least a sidewall portion of the mattress, including: (i) a first portion of a first closure; (ii) a first longitudinal panel; (iii) a second longitudinal panel; (iv) a first transverse panel; and (v) a second transverse panel; and (2) a first bedding element including: (i) a medial panel with a second portion of the first closure; (ii) a first panel extending from a first longitudinal edge of the medial panel; and (iii) a second panel extending from a second longitudinal edge of the medial panel such that, when the first and second portions of the first closure are interconnected, the first panel covers at least a portion of the first longitudinal panel and the second panel covers at least a portion of the second longitudinal panel. In one embodiment, the retention element may be interconnected to the mattress by one or more of a hook and loop system, a zipper, buttons, and snaps.

Optionally, the bedding system may further comprise: a second bedding element with a width greater than a width of the first bedding element, the second bedding element interconnectable to the first bedding element. In one embodiment, a two-part closure interconnects the second bedding element to the first bedding element. Optionally, the two-part closure comprises two two-part closures to interconnect the second bedding element to the first bedding element. Alternatively, in another embodiment, buttons interconnect the first and second bedding elements. In one embodiment, the buttons engage apertures in the first bedding element to interconnects the second bedding element to the first bedding element. In another embodiment, buttons affixed to the first bedding element engage apertures in the second bedding element to selectively interconnect the second bedding element to the first bedding element. In still another embodiment, buttons engage buttons apertures in the retention element and the first and second bedding elements to interconnect the first and second bedding elements to the retention element.

It is yet another aspect of the present invention to provide a bedding system selectively interconnectable to a mattress of a bed. The bedding system comprises: (1) a retention element adapted to cover at least a sidewall portion of the mattress; (2) a first bedding element; and (3) a second bedding element, wherein at least the first bedding element and the second bedding element may be interconnected by buttons. Optionally, the first bedding element may include a medial panel, a first panel extending from a first longitudinal edge of the medial panel, and a second panel extending from a second longitudinal edge of the medial panel.

In one embodiment, the first bedding element is interconnected to the retention element by a two-part closure. In another embodiment, the first bedding element is interconnected to the retention element by buttons.

In one embodiment, the bedding system further comprises buttons affixed to the retention element in alignment with button holes formed through the first bedding element and the second bedding element. In one embodiment, the buttons are aligned generally parallel to a longitudinal axis of the first bedding element.

Optionally, in another embodiment, buttons affixed to the first bedding element align with button holes formed in the second bedding element for interconnecting the first and second bedding elements. In still another embodiment, buttons affixed to the second bedding element align with button holes formed in the first bedding element. Alternatively, the bedding system further comprises buttons affixed to the second bedding element in alignment with button holes formed through the first bedding element and the retention element. In another embodiment, button holes are formed through each of the retention element, the first bedding element, and the second bedding element to receive double buttons to interconnect the retention element to each of the first and second bedding elements. In yet another embodiment, the retention element may be interconnected to the mattress by one or more of a hook and loop system, a zipper, buttons, and snaps.

Yet another aspect of the present invention is a method of making a bedding system to be selectively retained by a mattress. The method generally comprising: (1) forming a retention element including a first longitudinal panel connected to a second longitudinal panel by first and second transverse panels and at least one first closure; (2) forming a first bedding element that generally includes: (i) at least one second closure aligned with the at least one first closure of the retention element; and (ii) at least one third closure; and (3) forming a second bedding element that includes at least one fourth closure aligned with the at least one third closure of the first bedding element. In one embodiment, the first, second, third, and fourth closures comprise one or more of a hook and loop system, a zipper system, a plurality of buttons and button holes, and a plurality of snaps. In one embodiment, the at least one third closure comprises two closures positioned proximate to peripheral edges of the first bedding element. The at least one fourth closure of the second bedding element comprises two closures positioned proximate to peripheral edges of the second bedding element in alignment with the two closures of the third closure.

Another aspect of the present invention is a method of making a bed with a bedding system. The method generally includes, but is not limited two: (1) positioning a retention element on a mattress of the bed, the retention element including a first portion of a first closure; (2) positioned a first bedding element proximate to the retention element, the first bedding element including a second portion of the first closure and at least one second closure; (3) interconnecting the second portion of the first closure to the first portion such that the first bedding element is interconnected to the retention element; (4) positioned a second bedding element proximate to the first bedding element, the second bedding element including at least one third closure; and (5) interconnecting the second and third closures such that the second bedding element is interconnected to the first bedding element. In one embodiment, the second and third closures comprise zippers. In another embodiment, the second and third closures comprise buttons and button holes. Optionally, in another embodiment, the method may further include interconnecting the retention element to the mattress with a closure.

As used herein, the phrases "two-part fastener" and "two-part closure" may be any two-part closure known to those of skill in the art or developed in the future. In one embodiment, the two-part closure is a zipper. In another embodiment, the two-part closure is a hook and loop system, such as Velcro™. Alternatively, the two-part closure may comprise snaps or other fasteners.

The term "mattress," as used herein, refers to mattresses of all sizes and thickness. Accordingly, the mattress may be sized for a crib or a toddler's bed. The mattress may also be for a fold-out bed (such as a sofa sleeper, a cot, or a murphy bed). Alternatively, the mattress may be one of a twin, full, queen, king, or any other size mattress. The bedding system of the present invention may also be sized to fit an inflatable mattress of any size or shape.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary of the Invention, Brief Description of the Drawings, Detailed Description, Abstract, and Claims themselves.

The Summary of the Invention is neither intended, nor should it be construed, as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF THE DRAWINGS

The accompanying drawings, which are incorporated herein and constitute a part of the specification, illustrate embodiments of the invention and together with the Summary of the Invention given above and the Detailed Description given below serve to explain the principles of these embodiments. In certain instances, details that are not necessary for an understanding of the disclosure or that render other details difficult to perceive may have been omitted. It should be understood, of course, that the present invention is not necessarily limited to the particular embodiments illustrated herein. Additionally, one of skill in the art will appreciate that the drawings are not necessarily to scale.

Figure 1A:
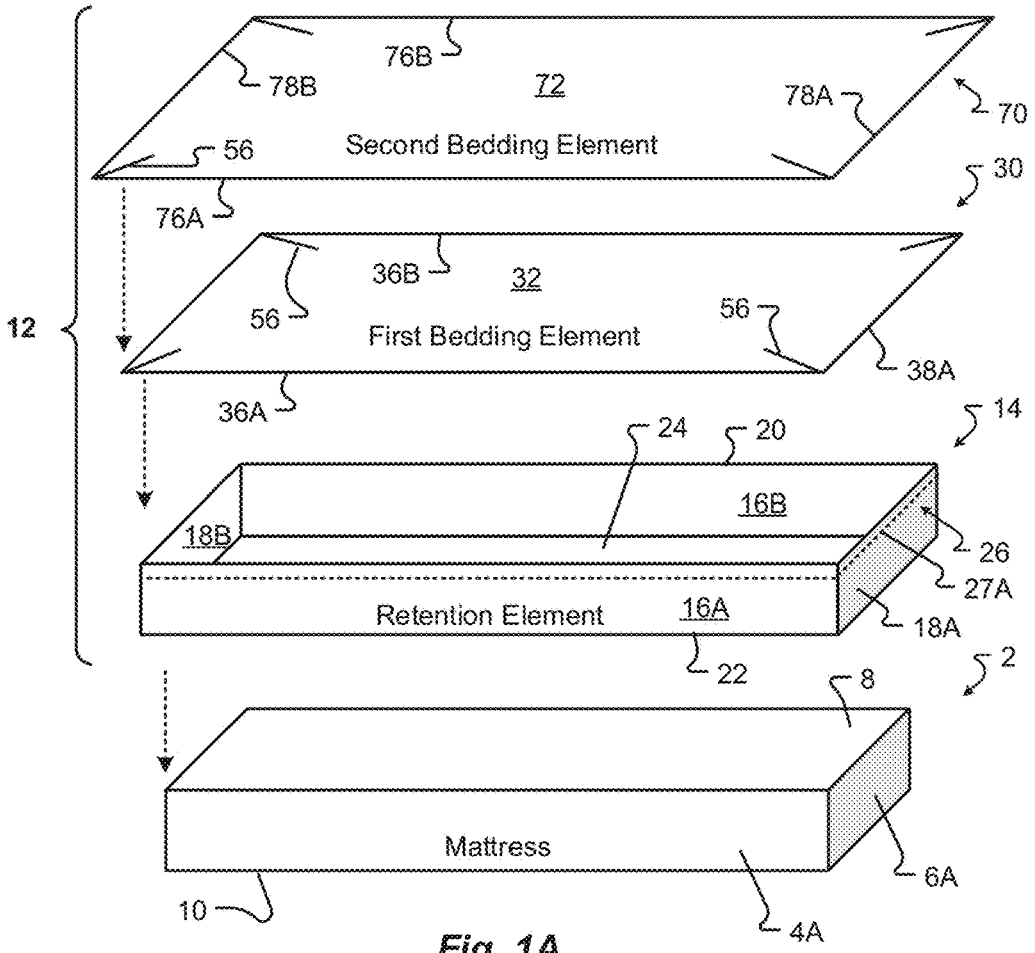
FIG. 1A is an exploded perspective view of a bedding system of an embodiment of the present invention proximate to a mattress of a bed, the bedding system comprising a retention element, a first bedding element, and a second bedding element.

Similar components and/or features may have the same reference number. Components of the same type may be distinguished by a letter following the reference number. If only the reference number is used, the description is applicable to any one of the similar components having the same reference number.

To assist in the understanding of one embodiment of the present invention the following list of components and associated numbering found in the drawings is provided herein:

Number Component
2 Mattress
4A First longitudinal sidewall of mattress
4B Second longitudinal sidewall of mattress
6 First transverse sidewall
6B Second transverse sidewall
8 Top portion
10 Bottom portion
12 Bedding system
14 Retention element
16A First longitudinal panel
16B Second longitudinal panel
18A First transverse panel
18B Second transverse panel
20 Upper (peripheral) edge
22 Lower (peripheral) edge
24 Optional bottom panel
26 First closure
27A First portion of first closure
27B Second portion of first closure
30 First bedding element (or sheet)
32 Exterior surface portion of first bedding element
34 Interior surface portion of first bedding element
36A First peripheral edge of first bedding element
36B Second peripheral edge of first bedding element
38A Third peripheral edge of first bedding element
40 Longitudinal axis of first bedding element
42 Second closure
43A First portion of second closure
43B Second portion of second closure
44 Third closure
45A First portion of third closure
45B Second portion of third closure
46 Fourth closure
47A First portion of fourth closure
47B Second portion of fourth closure
50 Medial panel of first bedding element
52 First panel of first bedding element
54 Second panel of first bedding element
56 Slots
60 Button hole
64 Button
70 Second bedding element (or cover/duvet)
72 Exterior surface portion
74 Interior surface portion
76A First peripheral edge
76B Second peripheral edge
78A Foot end
78B Head end
80 Pocket
82 Aperture for pocket
112 Bedding system
114 Retention element
116A First longitudinal panel
116B Second longitudinal panel
124 Optional bottom panel
130 First bedding element (or sheet)
132 Exterior surface portion
134 Interior surface portion
136A First peripheral edge

136B Second peripheral edge
138A Third peripheral edge
140 Longitudinal axis
150 Medial panel
152 First panel
154 Second panel
156 Slots
160 Button holes
162 Double button
164 Button interconnected to the retention element
170 Second bedding element (or cover/duvet)
172 Exterior surface portion
174 Interior surface portion
176A First peripheral edge
176B Second peripheral edge
178A Foot end
178B Head end
182 Aperture for pocket
212 Bedding system
214 Retention element
216A First longitudinal panel
216B Second longitudinal panel
224 Optional bottom panel
227 Optional first portion of a first closure
230 First bedding element (or sheet)
232 Exterior surface portion
234 Interior surface portion
236A First peripheral edge
236B Second peripheral edge
238A Third peripheral edge
240 Longitudinal axis
250 Medial panel
252 First panel
254 Second panel
256 Slots
260 Button holes
266 Button interconnected to the second bedding element
270 Second bedding element (or cover/duvet)
272 Exterior surface portion
274 Interior surface portion
276A First peripheral edge
276B Second peripheral edge
278A Foot end
278B Head end
282 Aperture for pocket
312 Bedding system
314 Retention element
316A First longitudinal panel
316B Second longitudinal panel
324 Optional bottom panel
326 First closure
327A First portion of first closure
327B Second portion of first closure
330 First bedding element (or sheet)
332 Exterior surface portion
334 Interior surface portion
336A First peripheral edge
336B Second peripheral edge
338A Third peripheral edge
340 Longitudinal axis
350 Medial panel
352 First panel
354 Second panel
356 Slots
360 Button holes
366 Button interconnected to the second bedding element
368 Button interconnected to first bedding element
370 Second bedding element (or cover/duvet)
372 Exterior surface portion
374 Interior surface portion
376A First peripheral edge
376B Second peripheral edge
378A Foot end
378B Head end
382 Aperture for pocket

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Referring now to FIGS. 1-5, a bedding system 12 of an embodiment of the present invention is illustrated. The bedding system 12 generally comprises a retention element 14, a first bedding element 30, and a second bedding element 70.

The retention element 14 generally includes a first portion 27A of a first two-part closure 26 and a first longitudinal panel 16A connected to a second longitudinal panel 16B by first and second transverse panels 18A, 18B. In one embodiment, the retention element 14 has a generally rectangular shape.

The retention element 14 generally has a size and shape selected to fit a mattress 2 of a bed. More specifically, the horizontal cross-sectional shape of the retention element 14 generally corresponds to the horizontal cross-sectional shape of the mattress 2. Additionally, the length and width of the retention element 14 are about equal to, or slightly greater than, the corresponding length and width of the mattress 2.

Figure 1B:
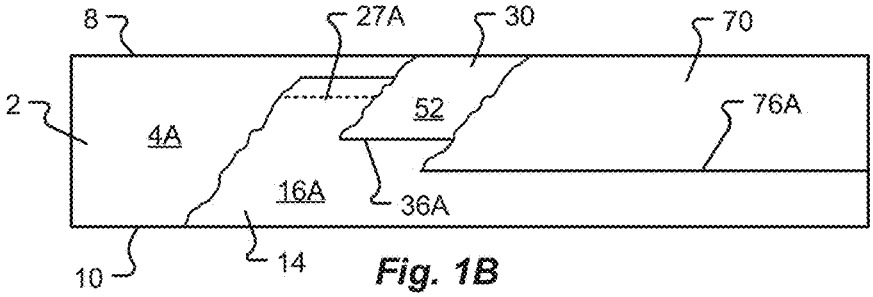
FIG. 1B is a cutaway side elevation view of the bedding system of FIG. 1A illustrating the relative positions of the retention element, the first bedding element, and the second bedding element when the bedding system is positioned on the mattress.

The first and second longitudinal panels 16A, 16B are adapted to contact at least a portion of respective first and second longitudinal sidewalls 4A, 4B of the mattress 2 when the retention element 14 is positioned on the mattress 2. Similarly, the first and second transverse panels 18 contact at least a portion of respective first and second transverse sidewalls 6 of the mattress when the retention element is on the mattress 2. In one embodiment, the panels 16-18 of the retention element 14 substantially cover corresponding sidewalls 4-6 of the mattress 2 as generally illustrated in FIG. 1B. In another embodiment, the panels 16-18 of the retention element 14 contact at least a portion of the top portion 8 of the mattress 2. Optionally, an elastic material or other biasing element may be positioned proximate to one or more of an upper peripheral edge 20 and a lower peripheral edge 22 of one or more of the panels 16-18 to decrease at least one of the length and the width of the retention element 14 with respect to the mattress 2.

In one embodiment, the retention element 14 optionally includes a bottom panel 24 adapted to at least partially contact a bottom portion 10 of the mattress 2. In one embodiment, the bottom panel 24 is continuous between the first and second longitudinal panels 16A, 16B and between the first and second transverse panels 18A, 18B. In this manner, the optional bottom panel 24 may cover all of the bottom portion 10 of the mattress. Alternatively, the bottom panel 24 is discontinuous such that there are apertures in the bottom panel 24 and only some of the bottom portion 10 of the mattress is covered.

Optionally, the first closure portion 27A may extend substantially continuously around the retention element. Accordingly, in one embodiment, each of the panels 16A, 16B, 18A, 18B includes a portion of the first closure portion 27A. Alternatively, one or more of the panels 16A, 16B, 18A, 18B may be devoid of the first closure portion 27A. Thus, in another embodiment, the first closure portion 27A is only included on the first and second longitudinal panels 16A, 16B. In one embodiment, the first closure portion 27A is spaced from an upper peripheral edge 20 of the retention element 14. In another embodiment, the first closure portion 27A is positioned proximate to, or at, the edge 20 of the retention element 14. In one embodiment, the first closure portion 27A is positioned proximate to an upper peripheral edge 20 of the retention element 14. In another embodiment, the first closure portion 27A is substantially parallel to the upper peripheral edge 20. However, one of skill in the art will appreciate that the first closure portion 27A may be arranged at any location of the retention element. Accordingly, in another embodiment, the first closure portion 27A may alternatively be spaced from the upper peripheral edge, or closer to the lower peripheral edge 22 than to the upper peripheral edge.

Figure 1C:
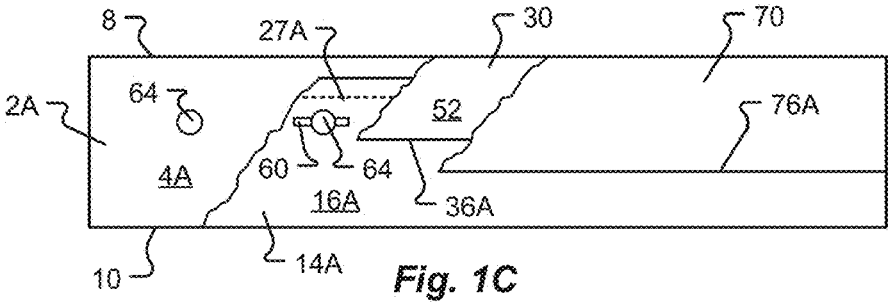
FIG. 1C is a cutaway side elevation view of a bedding system of another embodiment including a retention element interconnected to a mattress with a closure.

Referring now to FIG. 1C, the retention element 14A may optionally be interconnected to the mattress 2A with one or more fasteners or closures. One of skill in the art will appreciate that any type of closure or fastener may be used to interconnect any embodiment of retention element of the present disclosure to the mattress. For example, as illustrated in FIG. 1C, buttons 64 positioned on the mattress 2A may engage button holes 60 formed in the retention element 14A. Alternatively, the retention element 14A may include buttons that engage button loops or button holes formed on the mattress 2A. In another embodiment, one or more of snaps, buttons, a zipper, and a hook and loop fastener are used to interconnect the retention element 14A to the mattress 2A.

The first bedding element 30 generally includes an exterior surface 32 opposite to an interior surface 34, and a first peripheral edge 36A opposite to a second peripheral edge 36B. A second portion 27B of the first closure 26 is interconnected to the interior surface 34 to align with the first portion 27A of the first closure 26. In this manner, the second portion 27B is interconnectable to the first portion 27A of the first closure 26. In one embodiment, the first two-part closure 26 is a zipper. A pull for the first closure 26 may be associated with the second closure portion 27B. Alternatively, the zipper pull may be associated with the first closure portion 27A.

In one embodiment, the first bedding element 30 has at least one of a length that is greater than a length of the longitudinal panels 16 and a width that is greater than a length of the first and second transverse panels 18 of the retention element 14. Accordingly, when the first bedding element 30 is interconnected to the retention element 14, the first and second peripheral edges 36A, 36B drape at least partially down over the first and second longitudinal sidewalls 4A, 4B of the mattress as generally illustrated in FIG. 1B.

Figure 2:
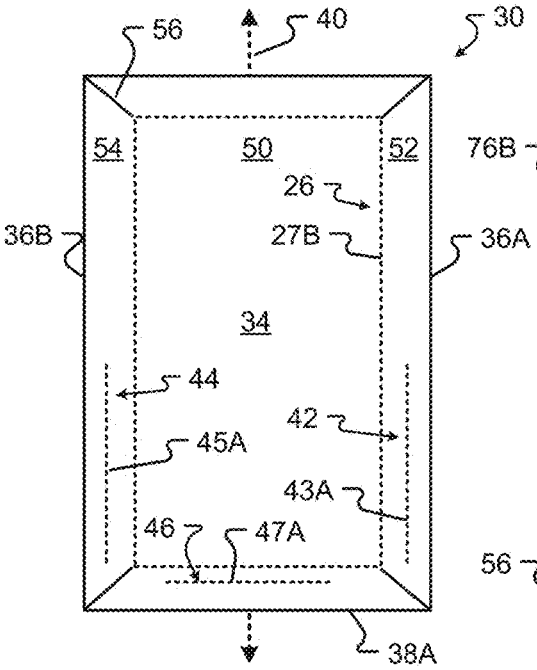
FIG. 2 is a bottom plan view of the first bedding element of the bedding system of FIG. 1A.

Optionally, referring now to FIG. 2, the first bedding element 30 comprises first and second panels 52, 54 that extend from a medial panel 50. In one embodiment, the first and second panels 52, 54 extend about 1 inch from the medial panel 50; however, one of skill in the art will appreciate that the first and second panels 52A, 52B may be of any predetermined width. In another embodiment, the first and second panels extend between about 0.5 inch and about 8 inches from the medial panel 50. Slots 56 may be formed proximate to corners of the first bedding element 30 such that the first and second panels 52, 54 may drape at least partially down against the sidewalls 4 of the mattress. Optionally, a closure, such as but not limited to, a zipper, a snap, or a tie may be interconnected to adjacent sides of one or more of the slots 56. In this manner, the slots 56 may be at least partially closed by the closure.

The first bedding element 30 also includes a first portion 43A of a second two-part closure 42 and a first portion 45A of a third two-part closure 44. In one embodiment, the first portions 43A, 45A are interconnected to the first bedding element at a position substantially parallel to a longitudinal axis 40 of the first bedding element 30 that is substantially equally spaced from the first and second peripheral edges 36A, 36B. Optionally, the first portions 43A, 45A are positioned on the first and second panels 52, 54 respectively. In one embodiment, the first portions 43A, 45A are positioned closer to the respective first and second peripheral edges 36A, 36B than the second portion 27B of the first closure 26. In another embodiment, the first closure 26 is arranged such that the first and second portions 27A, 27B are not between the top portion 8 of the mattress 2 and the interior surface portion 34 of the first bedding element 30 when the first bedding element 30 is positioned on the mattress 2.

Preferably, the first portions 43A, 45A extend along at least a portion of a length of each of the first and second peripheral edges 36A, 36B as illustrated in FIG. 2. For example, in one embodiment, the first portions 43A, 45A of the second and third closures 42, 44 extend up to about one-third of the length of edges 36A, 36B. Alternatively, the first portions 43A, 45A may extend up to about one-half of the length of edges 36. However, in another embodiment, the first portions 43A, 45A have a length substantially equal to the length of the first and second longitudinal sidewalls 4A, 4B of the mattress 2.

Figure 5A:
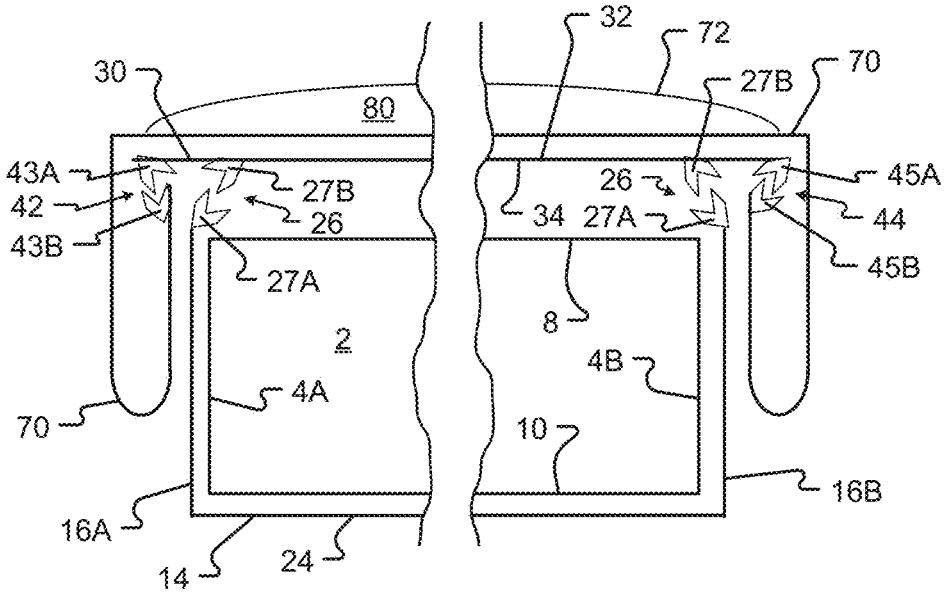
FIG. 5A is a cross-sectional view of the bedding system taken along line 5A-5A of FIG. 4 and illustrating the arrangement of a first closure to interconnect the first bedding element to the retention element and a second closure and a third closure to interconnect the second bedding element to the first bedding element.
Figure 5B:
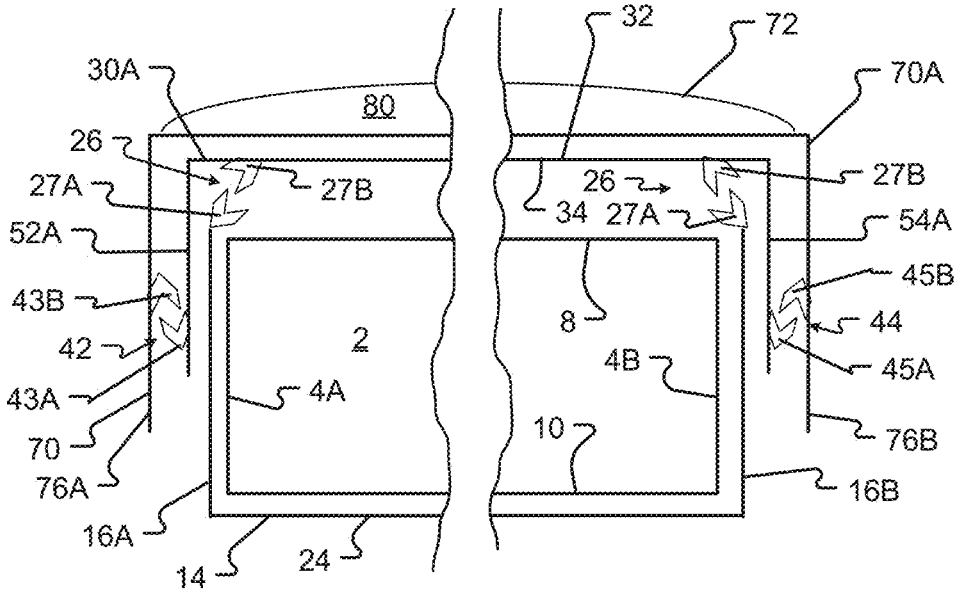
FIG. 5B is another cross-sectional view of the bedding system of FIG. 1 illustrating an alternate position of the second and third closures to interconnect the first and second bedding elements.

In one embodiment, illustrated in FIGS. 2 and 5A, the first closure portions 43A, 45A of the second and third closures 42, 44 are interconnected to the interior surface 34 of the first bedding element 30. Alternatively, the first closure portions 43A, 45A may optionally be interconnected to the exterior surface 32 of the first bedding element 30A as illustrated in FIG. 5B. FIG. 5B also illustrates an embodiment of the first bedding element 30A that is wider than the mattress 2 such that the first and second panels 52A, 52B drape downwardly proximate to the longitudinal panels 16A, 16B of the retention element.

Additionally, the first bedding element 30 may optionally include a first portion 47A of a fourth two-part closure 46. The first portion 47A is preferably arranged substantially perpendicular to the longitudinal axis 40 proximate to a third peripheral edge 38A.

Optionally, the first bedding element 30 may be interconnected directly to the mattress 2 without the use of the retention element 14. Accordingly, one embodiment, the first bedding element 30 includes a second portion 27B of a first two-part closure 26 that interconnects to a first portion 27A of the first closure 26 affixed to the mattress 2. In one embodiment, the first portion 27A is positioned on at least one of the longitudinal sidewalls 4 of the mattress. Optionally, in another embodiment, the first bedding element 30 is interconnected to the mattress 4 by a plurality of buttons or snaps.

In one embodiment, the first bedding element 30 is a sheet. The first bedding element 30 may be formed of any suitable material. In one embodiment, the first bedding element includes cotton. In another embodiment, the first bedding element comprises at least one of cotton, wool, silk, and a synthetic material. Optionally, the first bedding element is pre-washed, or pre-shrunk, before the portions of the two-part closures 26, 42, 44, 46 are affixed to the first bedding element.

The second bedding element 70 generally comprises an exterior surface 72, an interior surface 74, and a first peripheral edge 76A generally parallel to a second peripheral edge 76B. The second bedding element 70 has a shape generally corresponding to the shape of the first bedding element 30. In one embodiment, a width of the second bedding element 70 is greater than the width of the first bedding element 30. Accordingly, when the second bedding element 70 is interconnected to the first bedding element 30 at least a portion of the first bedding element 30 extends downwardly past the first and second peripheral edges 36A, 36B of the first bedding element 30 as illustrated in FIGS. 1B and 5A. Optionally, the second bedding element 70 is longer than the first bedding element 30.

Slots 56 may be formed proximate to corners of the second bedding element 70 similar to the slots 56 of the first bedding element. Closures may be associated with one or more of the slots 56 to draw the slots 56 at least partially closed.

The second bedding element 70 also includes a second portion 43B of the second closure 42 and a second portion 45B of the third closure 44. The second portions 43B, 45B are positioned on the second bedding element 70 to align with the corresponding first portions 43A, 45A of the first bedding element 30. In this manner, the second bedding element may be selectively interconnected to the first bedding element.

In one embodiment, the second portions 43B, 45B are interconnected to the interior surface portion 74. Optionally, the second portions 43B, 45B may be positioned proximate to the respective first and second peripheral edges 76. In this manner, when the second and third closures 42, 44 are interconnected as generally illustrated in FIG. 5A, the second bedding element 70 drapes from the exterior surface portion 32, around the peripheral edges 36A, 36B and proximate to the interior surface portion 34 of the first bedding element 30. In another embodiment, the second portions 43B, 45B may be spaced from the peripheral edges 76A, 76B as illustrated in FIG. 5B.

Optionally, a second portion 47B of the fourth two-part closure 46 may be interconnected to the second bedding element 70 to align with the first portion 47A. In this manner, a foot portion of the first bedding element 30 may be interconnected to the second bedding element. Accordingly, the first and second portions 47A, 47B of the fourth closure 46 may be separated to provide more room for an occupant of the bed. The first and second bedding elements 30, 70 are generally illustrated as interconnectable using three two-part closures 42, 44, and 46; however, one of skill in the art will appreciate that the any one of the two-part closures 42-46 may independently interconnect the first and second bedding elements. Accordingly, in one embodiment, the first and second bedding elements 30, 70 only include one of the closures 42, 44, 46. In another embodiment, the first and second bedding element 30, 70 include any two of the closures 42, 44, 46. Alternatively, the first and second bedding elements may include all three of the closures 42, 44, 46.

The second bedding element 70 may be any type of a sheet or cover for a bed. The second bedding element 70 may comprise one or more of cotton, silk, nylon, wool, and a synthetic material. In one embodiment, the second bedding element 70 is comprised of a durable material suitable for outdoor use. In one embodiment, at least the exterior surface portion 72 of the second bedding element comprises a water-proof or a water-resistant material.

In one embodiment, the second bedding element 70 is a quilt. In another embodiment, the second bedding element 70 is a duvet-type cover comprising two or more layers that define a cavity or pocket 80. The pocket 80 may be sized to retain an insulating material. Thus, insulation may be removed from, or added to, the pocket 80 to adjust the amount of insulation of the second bedding element 70. In this manner, the second bedding element 70 may be adjusted for year-round used, from a summer-weight duvet to a winter-weight duvet. Optionally, retention elements, such as ties, snaps, or hooks, may be positioned within the pocket 80 for interconnected to a selected insulating material.

Figure 3:
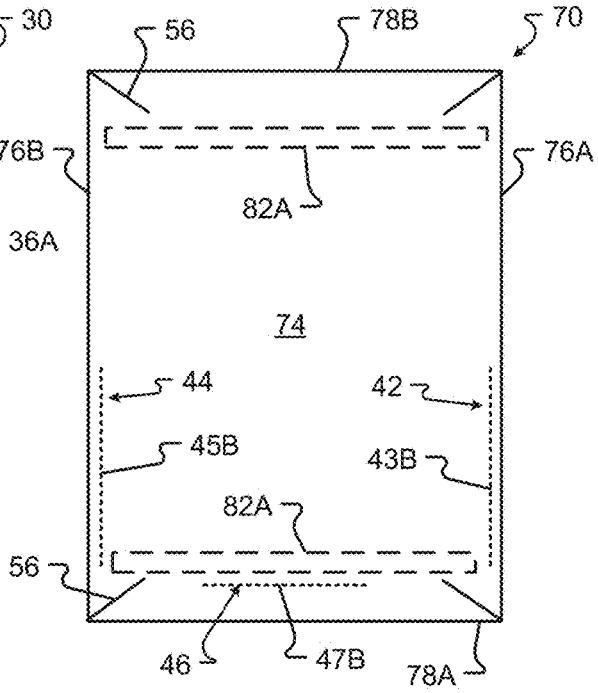
FIG. 3 is a bottom plan view of the second bedding element of the bedding system of FIG. 1A.
Figure 4:
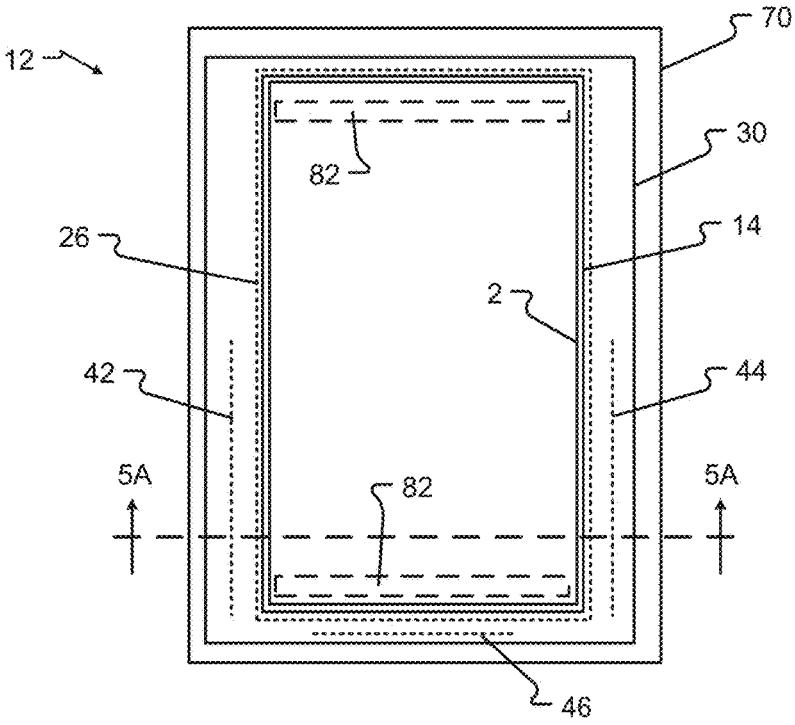
FIG. 4 is a top plan view of the bedding system of FIG. 1A positioned on the mattress of the bed with the mattress, the retention element, and the first bedding element shown through the second bedding element.

Preferably the pocket 80 is closed on at least the first and second peripheral edges 76. Optionally, the pocket 80 is closed proximate to one or more of the foot end 78A and the head end 78B of the second bedding element 70. An aperture 82, illustrated in FIG. 4, for accessing the pocket 80 may optionally be positioned proximate to one or more of the foot 78A and the head 78B of the second bedding element. In one embodiment, the aperture 82 generally comprises a slot in the exterior surface portion 72 of the second bedding element. Alternatively, the aperture 82A is formed in the interior surface portion 74 as illustrated in FIG. 3. Optionally, the aperture 82, 82A may include a closure, such as a zipper, buttons, or snaps. The pocket 80 may be formed on a portion of the width of the second bedding element 70 as illustrated in FIG. 5A. Alternatively, the pocket may generally extend from the first peripheral edge 76A to the second peripheral edge 76B as generally illustrated in FIG. 3.

To replace or clean the bedding system 12, the first and second bedding elements 30, 70 may be individually removed from the retention element 14. Optionally, the first and second bedding elements may be interconnected when the first bedding element 30 is removed from the retention element.

Figure 6:
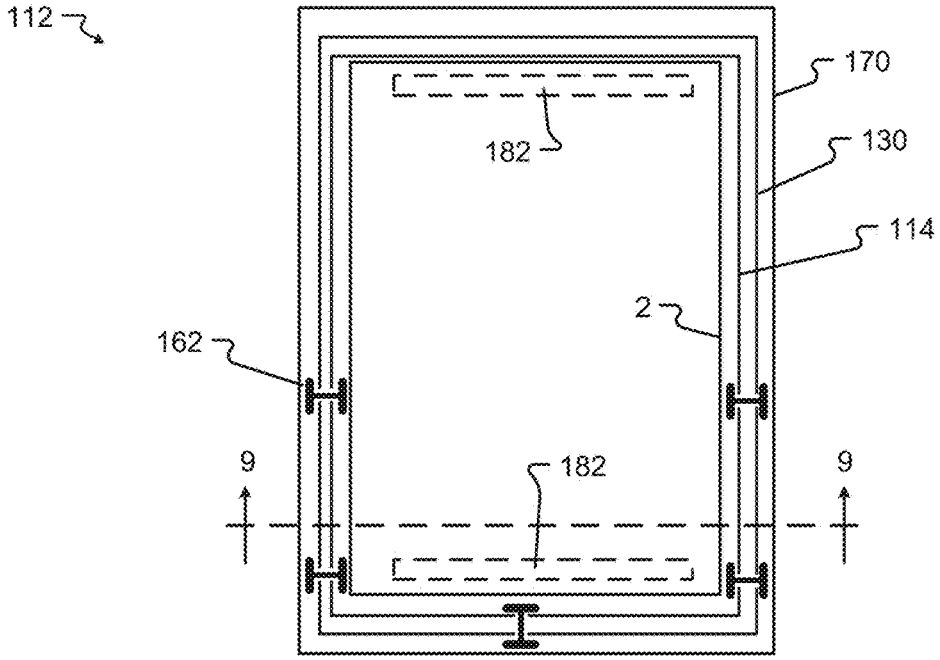
FIG. 6 is a top plan view of a bedding system of another embodiment of the present invention positioned on a mattress and showing a first bedding element and a second bedding element interconnected to a retention element by buttons.
Figure 7:
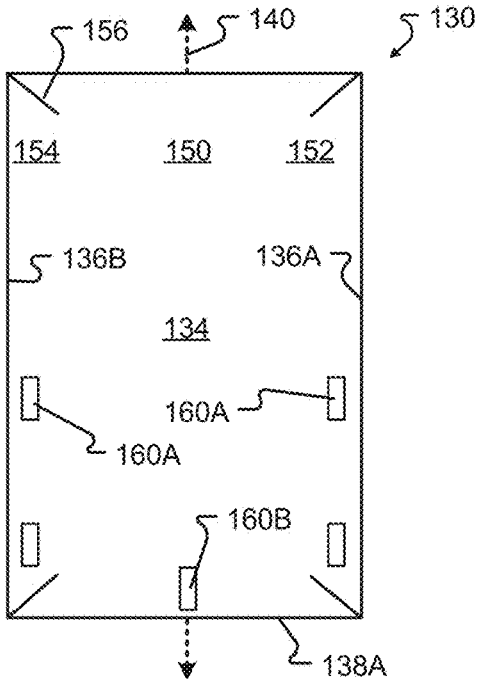
FIG. 7 is a bottom plan view of the first bedding element of the bedding system of FIG. 6.
Figure 8:
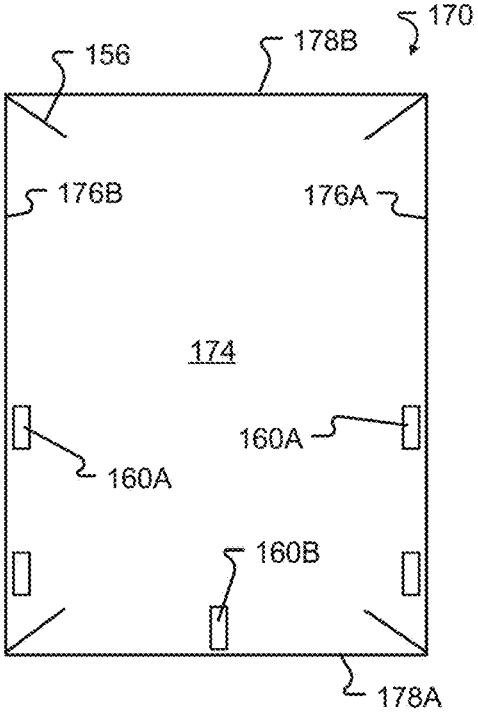
FIG. 8 is a bottom plan view of the second bedding element of the bedding system of FIG. 6.
Figure 9:
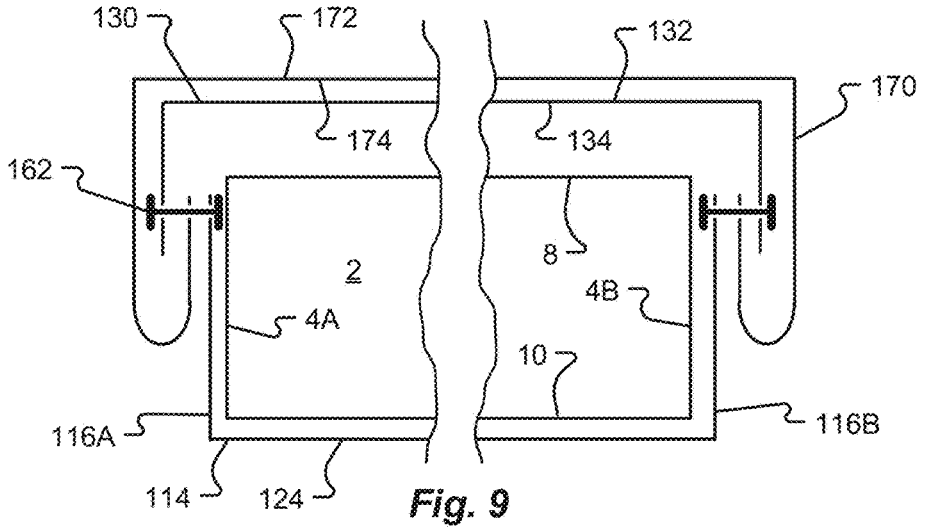
FIG. 9 is a cross-sectional view of the bedding system taken along line 9-9 of FIG. 6 and showing an arrangement of buttons used to interconnect the first and second bedding elements to the retention element.
Figure 10:
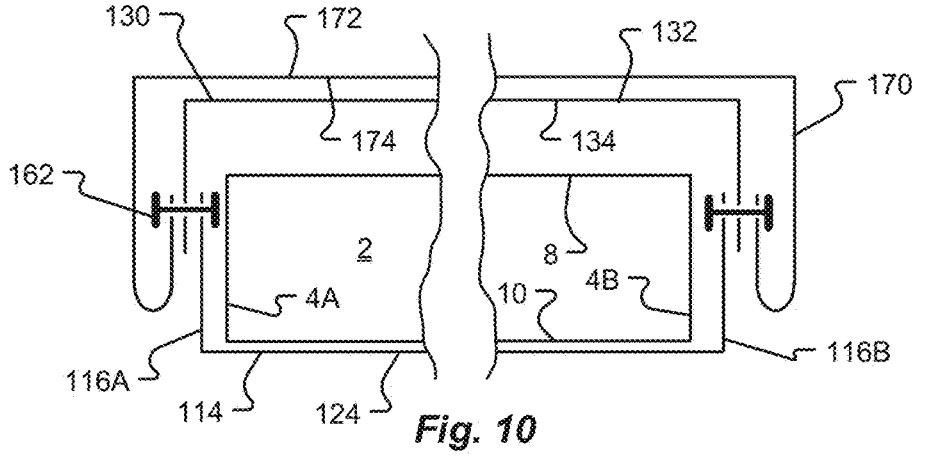
FIG. 10 is a cross-sectional view similar to FIG. 9 illustrating an alternate arrangement of the first and second bedding elements with respect to the buttons.

Referring now to FIGS. 6-10, a bedding system 112 of another embodiment of the present invention is generally illustrated. The bedding system 112 is similar to bedding system 12. However, the first and second bedding elements 130, 170 are interconnected to the retention element 114 by buttons. In one embodiment, the buttons are double buttons 162 with a first head and a second head that are interconnected by a shank. Although only five buttons 162 and button holes 160 are illustrated in FIGS. 6-7, this is merely for clarity. Accordingly, a plurality of buttons 162 and button holes 160 may be associated with bedding system 112.

In one embodiment of the present invention, at least the first and second bedding elements 130, 170 include aligned button holes 160A, 160B. The button holes 160A are generally arranged through the first and second bedding elements about parallel to the longitudinal axis 140 of the first bedding element 130. Said another way, the button holes 160A are arranged similar to the positions of the second and third two-part closures 42, 44 of the bedding system 12. Optionally, button holes 160B may be arranged generally perpendicular to the longitudinal axis 140 such that the foot end 178A of the second bedding element 170 may be interconnected to the first bedding element and, optionally, to the retention element.

Optionally, the retention element 114 may also include button holes 160 that align with the button holes 160 of the first bedding element 130 and, optionally, the second bedding element 170. In this manner, one or more double buttons 162 may be used to interconnect the first and second bedding elements to the retention element 114 as illustrated, for example, in FIGS. 9 and 10.

Figure 11:
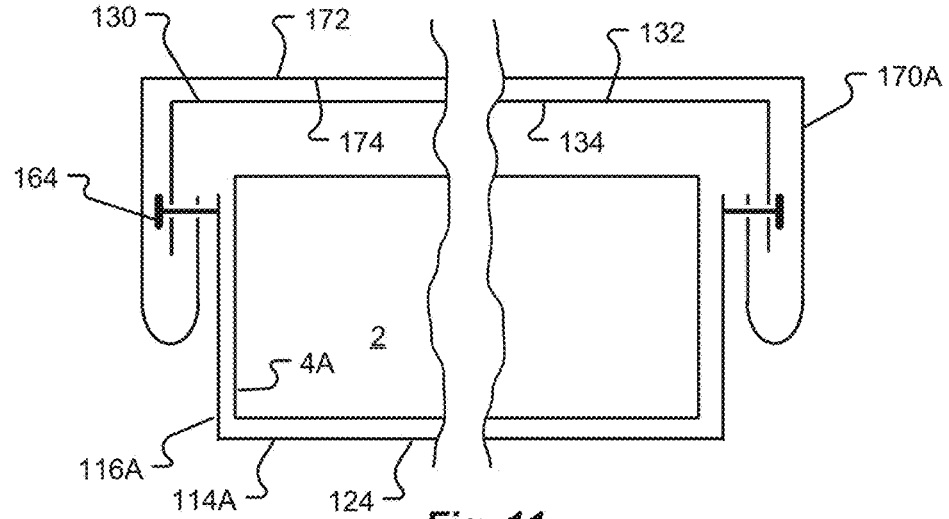
FIG. 11 is still another cross-sectional view similar to FIG. 9 and illustrating the first and second bedding elements interconnected to buttons affixed to the retention element.
Figure 12A:
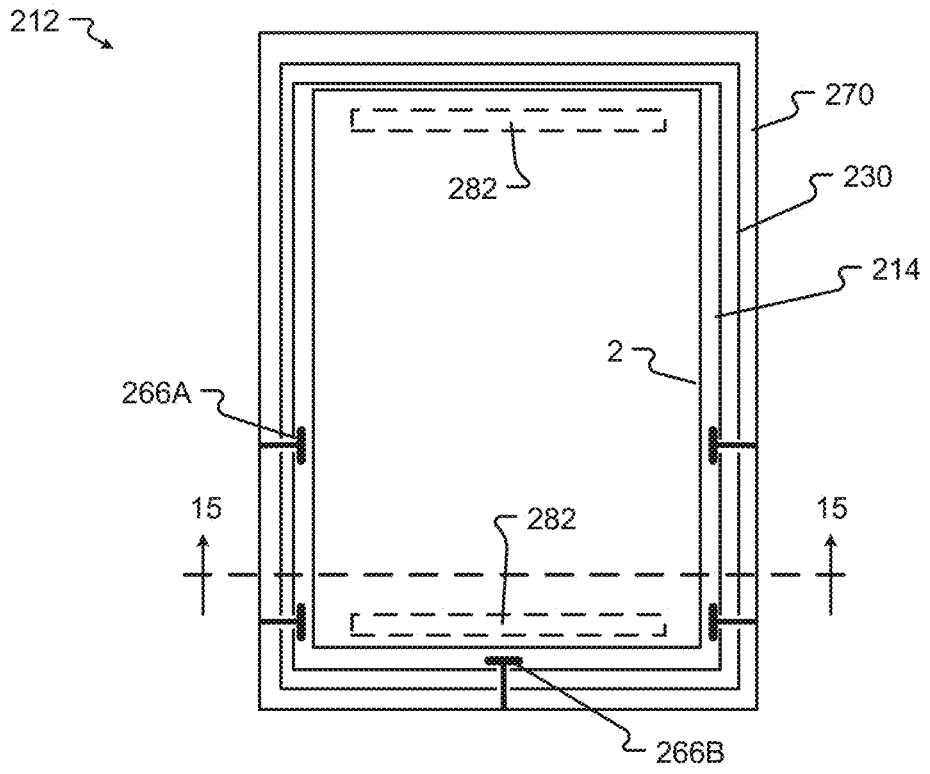
FIG. 12A is a top plan view of another bedding system of an embodiment of the present invention positioned on a mattress and showing a first bedding element and a retention element interconnected to a second bedding element by buttons fixed to the second bedding element.
Figure 12B:
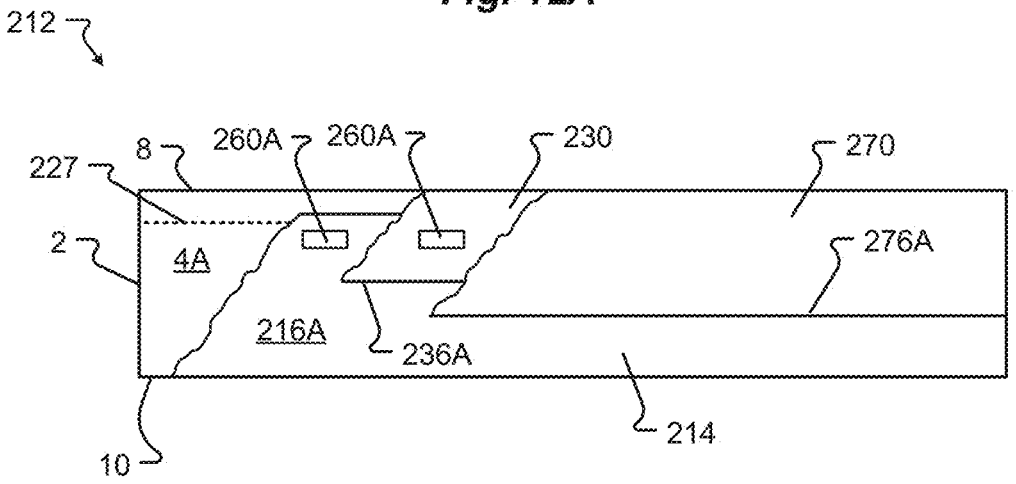
FIG. 12B is a cutaway side elevation view of the bedding system of FIG. 12A illustrating the relative positions of button holes of the retention element and the first bedding element when the bedding system is positioned on the mattress and illustrating an optional zipper to interconnect the retention element to the mattress.
Figure 13:
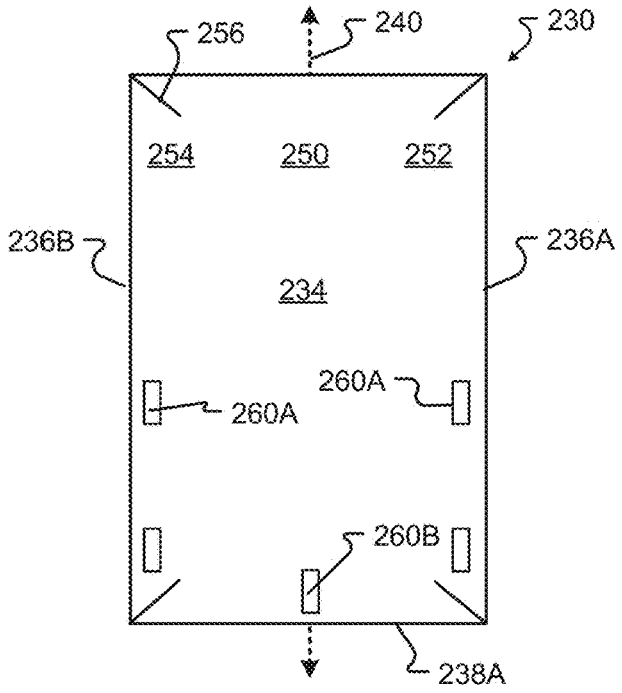
FIG. 13 is a bottom plan view of the first bedding element of the bedding system of FIG. 12A.
Figure 14:
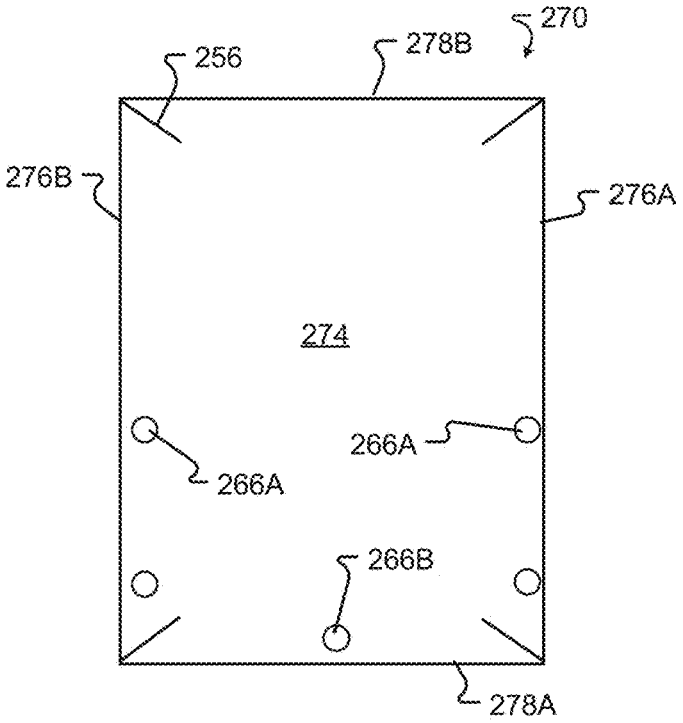
FIG. 14 is a bottom plan view of the second bedding element of the bedding system of FIG. 12A.
Figure 15:
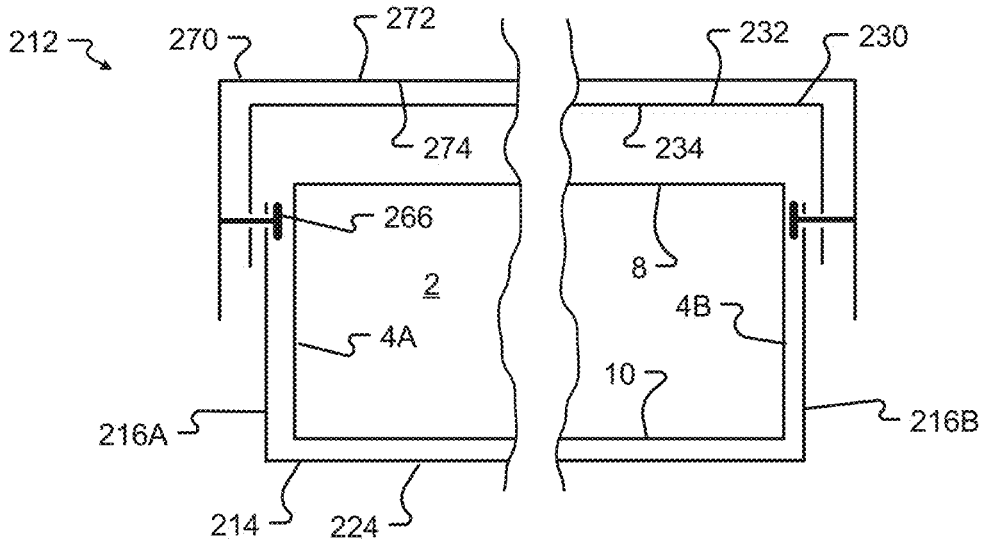
FIG. 15 is a cross-sectional view of the bedding system of FIG. 12A taken along line 15-15 and showing the retention element and the first bedding element interconnected to the second bedding system by buttons affixed to the second bedding element.
Figure 16A:
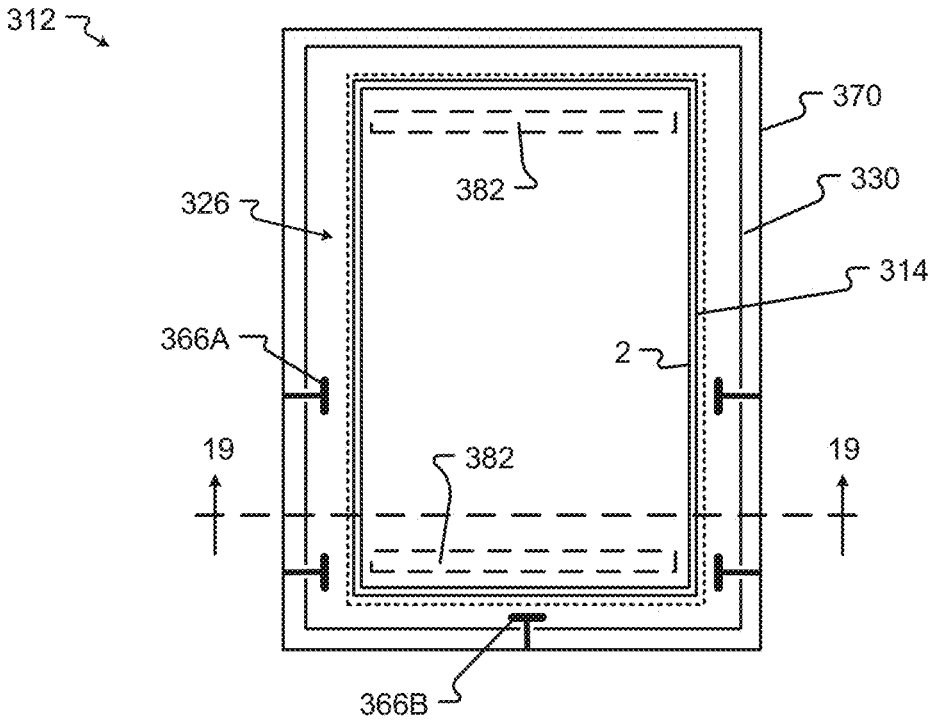
FIG. 16A is a top plan view of yet another bedding system of the present invention and illustrates a retention element positioned on a mattress with a first bedding element interconnected to the retention element by a two-part closure and a second bedding element interconnected to the first bedding element by buttons.
Figure 16B:
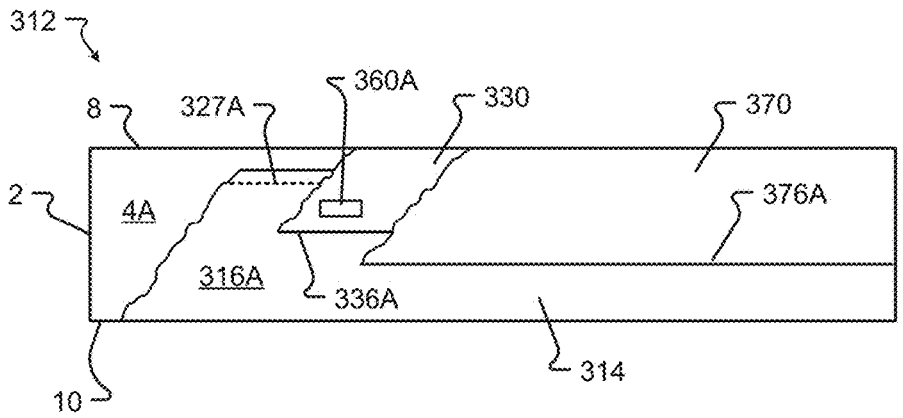
FIG. 16B is a cutaway side elevation view of the bedding system of FIG. 16A illustrating the relative positions of a two-part closure for interconnecting the first bedding element to the retention element as well as button holes of the first bedding element to receive a button affixed to the second bedding element.
Figure 17:
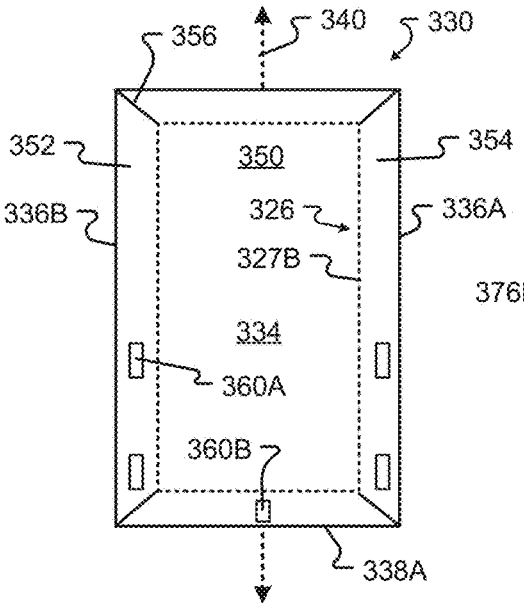
FIG. 17 is a bottom plan view of the first bedding element of the bedding system of FIG. 16A.
Figure 18:
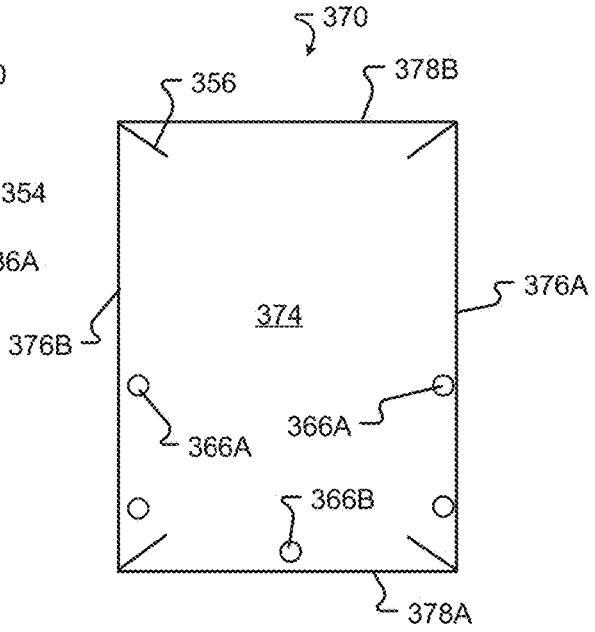
FIG. 18 is a bottom plan view of the second bedding element of the bedding system of FIG. 16A.
Figure 19:
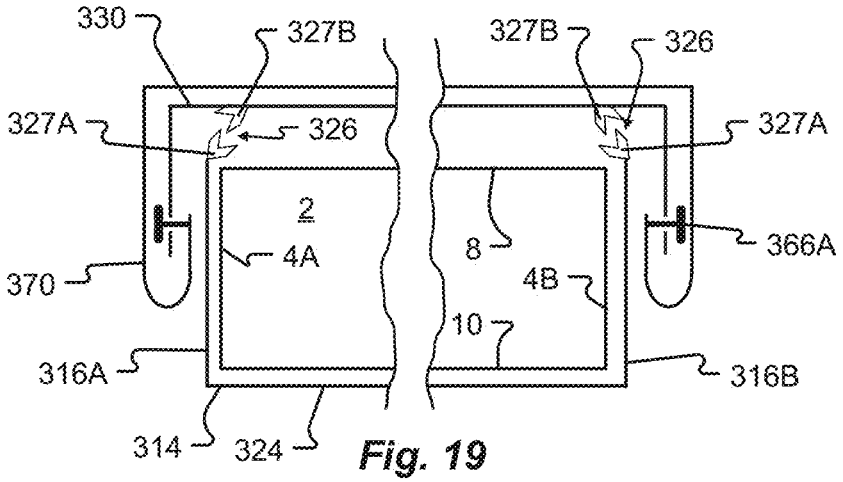
FIG. 19 is a cross-sectional view taken along line 19-19 of FIG. 16A and illustrates the first bedding element interconnected to the retention element by the two-part closure and the second bedding element interconnected to the first bedding element by the buttons.

In another embodiment, illustrated in FIG. 11, the buttons 164 are interconnected to the retention element 114. The buttons 164 are positioned on the retention element 114 to be received through the button holes 160 of the first bedding element 130 and, optionally, the second bedding element 170. Preferably, the buttons are interconnected to the retention element 114 such that sufficient space is left between the button 164 and the retention element 114 to receive one or more of the first bedding element and the second bedding element.

Referring now to FIGS. 12-15, yet another embodiment of a bedding system 212 of the present invention is generally illustrated. The bedding system 212 is similar to bedding systems 12, 112 and includes the same or similar features. More specifically, the bedding system 212 includes button holes 260 on the retention element 214 and the first bedding element 230 aligned with buttons 266 affixed to the second bedding element 270. The buttons 266A and button holes 260B may be positioned generally parallel to the longitudinal axis 240 of the first bedding element 230. Accordingly, the buttons 266A and button holes 260A are generally arranged in positions similar to the second and third closures 42, 44 of bedding system 12. Optionally, buttons 266B and buttons holes 260B may be arranged generally perpendicular to longitudinal axis 240 in a manner similar to the fourth fixture 46 of bedding system 12. As illustrated in FIG. 12B, the mattress 2 may optionally include a first closure portion 227 to engage a corresponding second closure portion (not illustrated) of the retention element 214. In this manner, the retention element 214 may be releasably interconnected to the mattress 2.

Referring now to FIGS. 16-20, still another bedding system 312 of an embodiment of the present invention is illustrated. The bedding system 312 includes both a two-part closure 326 to interconnect a retention element 314 to a first bedding element 330 and buttons 366 and button holes 360 to interconnect a second bedding element 370 to the first bedding element 330. Accordingly, the bedding system is similar to bedding systems 12, 112, 212 and includes the same or similar features.

The retention element 314 includes a first portion 327A of the two-part closure 326. A second portion 327B of the two-part closure 326 is affixed to the interior surface 334 of the first bedding element 330 in alignment with the first portion 327A. Accordingly, the first bedding element 330 may be selectively interconnected to the retention element 314 in a manner the same as, or similar to, the retention element 14 and first bedding element 30 of bedding system 12.

The first bedding element 330 also includes button holes 360 to receive buttons 366 affixed to an interior surface 374 of the second bedding element 370. The buttons 366A and button holes 360A are generally parallel to a longitudinal axis 340 of the first bedding element 330. In one embodiment, the buttons 366A and buttons holes 360A are arranged similar to the second and third two-part closures 42, 44 of bedding system 12. Optionally, additional button holes 360B and buttons 366B may be positioned on the first and second bedding elements 330, 370 substantially perpendicular to the longitudinal axis 340 similar to the fourth two-part closure 46 of bedding system 12. In this manner, the foot end 378A of the second bedding system 370 may be selectively interconnected to the first bedding system 330.

Figure 20:
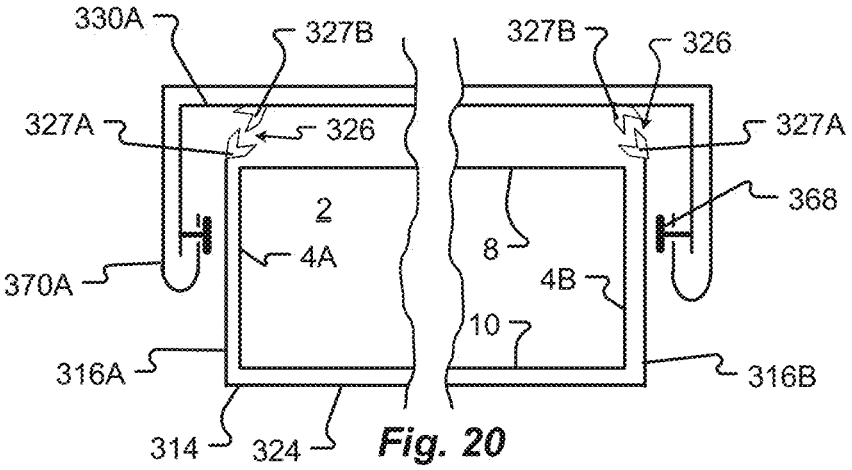
FIG. 20 is another cross-sectional view similar to FIG. 19 and illustrating another bedding system in which a two-part closure interconnects a first bedding element to a retention element and buttons affixed to the first bedding element interconnect the second bedding element to the first bedding element.

Referring now to FIG. 20, in another embodiment, the second bedding element 370A includes buttons holes 360 that are aligned with buttons 368 affixed to the first bedding element 330.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims. For example, aspects of the inventions disclosed in U.S. Pat. Nos. 3,570,026, 3,591,875, 4,922,565, 5,042,099, 6,757,923, 7,231,679, 7,487,561, 7,975,334, 8,332,976, 8,726,907, U.S. Pat. App. Pub. No. 20030177579, U.S. Pat. App. Pub. No. 20040139552, U.S. Pat. App. Pub. No. 20070113341, U.S. Pat. App. Pub. No. 20070174962, and U.S. Pat. App. Pub. No. 20150182032, all of which are incorporated by reference herein, may be incorporated into embodiments of the present invention.

What is claimed is:

1. A bedding system selectively retained by a mattress of a bed, comprising:

a retention element selectively received by the mattress, the retention element including a first portion of a first closure;

a first bedding element selectively interconnectable to the retention element, the first bedding element including:

a longitudinal axis;

a second portion of the first closure;

a first portion of a second closure generally parallel to the longitudinal axis and interconnected adjacent to a first peripheral edge of the first bedding element, which is adjacent to an upper portion of the retention element; and a first portion of a third closure generally parallel to the longitudinal axis and interconnected adjacent to a second peripheral edge of the first bedding element, which is adjacent to an upper portion of the retention element;

a second bedding element selectively interconnectable to the first bedding element, the second bedding element including:

a second portion of the second closure; and a second portion of the third closure;

wherein the second bedding element has a width that is greater than a width of the first bedding element, wherein the second portion of the second closure is adjacent to a first peripheral edge of the second bedding element, and wherein the second portion of the third closure is adjacent to a second peripheral edge of the second bedding element; and wherein the second bedding element, when connected to the first bedding element, drapes to conceal the first and second peripheral edges of the second bedding element.

2. The bedding system of claim 1, wherein:

the first portion of the second closure is closer to the first peripheral edge of the first bedding element than the second portion of the first closure; and the first portion of the third closure is closer to the second peripheral edge of the first bedding element than the second portion of the first closure.

3. The bedding system of claim 1, wherein the first bedding element further comprises:

a medial panel;

a first panel extending from a first longitudinal edge of the medial panel; and a second panel extending from a second longitudinal edge of the medial panel, wherein:

the second portion of the first closure is interconnected to the medial panel;

the first portion of the second closure is interconnected to the first panel; and the first portion of the third closure is interconnected to the second panel.

4. The bedding system of claim 1, wherein the mattress includes four sidewalls, wherein the retention element includes a first longitudinal panel connected to a second longitudinal panel by first and second transverse panels, and wherein, when the retention element is retained by the mattress, each of the longitudinal panels and the transverse panels contacts at least a portion of one of the four sidewalls of the mattress.

5. The bedding system of claim 4, wherein the retention element includes a bottom panel that contacts at least a portion of a bottom portion of the mattress when the retention element is retained by the mattress.

6. The bedding system of claim 1, wherein the first bedding element is a sheet and the second bedding element is a duvet including a pocket to receive an insulation.

7. A bedding system selectively interconnectable to a mattress of a bed, comprising:

a retention element adapted to cover at least a sidewall portion of the mattress, including:

a first portion of a first closure;

a first longitudinal panel;

a second longitudinal panel;

a first transverse panel; and a second transverse panel; and a first bedding element including:

a medial panel with a second portion of the first closure;

a first panel extending from a first longitudinal edge of the medial panel, the first panel also having a first portion of a second closure interconnected adjacent to a first peripheral edge of the first bedding element, which is adjacent to an upper portion of the retention element; and a second panel extending from a second longitudinal edge of the medial panel, the second panel also having a first portion of a third closure interconnected adjacent to a second peripheral edge of the first bedding element, which is adjacent to an upper portion of the retention element, a second bedding element selectively interconnectable to the first bedding element, the second bedding element including:

a second portion of the second closure; and a second portion of the third closure;

wherein, when the first and second portions of the first closure are interconnected, the first panel covers at least a portion of the first longitudinal panel and the second panel covers at least a portion of the second longitudinal panel; and wherein the second bedding element has a width that is greater than a width of the first bedding element, wherein the second portion of the second closure is adjacent to a first peripheral edge of the second bedding element, and wherein the second portion of the third closure is adjacent to a second peripheral edge of the second bedding element; and wherein the second bedding element, when connected to the first bedding element, drapes to conceal the first and second peripheral edges of the second bedding element.

8. The bedding system of claim 7, wherein the first closure comprises a two-part closure.

9. The bedding system of claim 7, wherein the first closure comprises buttons that engage corresponding apertures.

* * * * *